United States Patent [19]

Quante

[11] Patent Number: 4,713,910

[45] Date of Patent: Dec. 22, 1987

[54] BARRIER POST FOR PARKING LOTS AND PASSAGEWAYS

[75] Inventor: Heinrich Quante, Recklinghausen, Fed. Rep. of Germany

[73] Assignee: ARMO Gesellschaft fur Bauelemente, Bau - und Wohnbedarf GmbH, Recklinghausen, Fed. Rep. of Germany

[21] Appl. No.: 907,685

[22] PCT Filed: Dec. 10, 1985

[86] PCT No.: PCT/DE85/00518

§ 371 Date: Aug. 12, 1986

§ 102(e) Date: Aug. 12, 1986

[87] PCT Pub. No.: WO86/03531

PCT Pub. Date: Jun. 19, 1986

[30] Foreign Application Priority Data

Dec. 12, 1984 [DE] Fed. Rep. of Germany ..... 3445218
Apr. 23, 1985 [DE] Fed. Rep. of Germany ..... 3514626

[51] Int. Cl.[4] ..... E01F 13/00

[52] U.S. Cl. ..... 49/49; 49/25; 49/131

[58] Field of Search ..... 49/25, 35, 49, 131

[56] References Cited

U.S. PATENT DOCUMENTS

| | | | |
|---|---|---|---|
| 3,849,936 | 11/1974 | Geraci | 49/49 X |
| 4,416,085 | 11/1983 | Lybecker et al. | 49/340 |
| 4,576,508 | 3/1986 | Dickinson | 49/131 X |

FOREIGN PATENT DOCUMENTS

| | | | |
|---|---|---|---|
| 2,710,542 | 8/1978 | Fed. Rep. of Germany | 49/49 |
| 3004098 | 8/1981 | Fed. Rep. of Germany | 49/49 |
| 2058890 | 4/1981 | United Kingdom | 49/49 |
| 2102862 | 2/1983 | United Kingdom | 49/49 |

*Primary Examiner*—Kenneth Downey
*Attorney, Agent, or Firm*—Karl F. Ross; Herbert Dubno

[57] ABSTRACT

For the temporary blocking of the access to parking places, driveways and access roads a post is used, which is anchored in the ground and is foldable about an articulation arranged over the ground, whereby a drive is located in the post which can be activated over a receiver in correspondence with a portable emitter. Thereby, the post is suitably built as a hollow body, so that the drive and the remaining parts can be safely lodged therein. This way, the barrier post can be remote-controlled without difficulty from an approaching vehicle by means of a portable emitter, or for instance in the case of blocking the access to football stadiums, from a control center.

13 Claims, 7 Drawing Figures

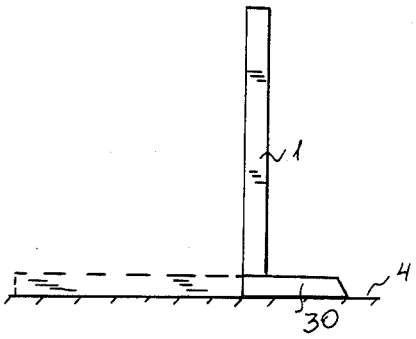
FIG. 5
FIG. 6
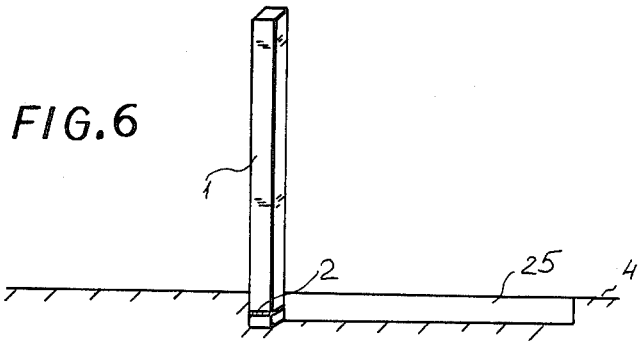
FIG. 7
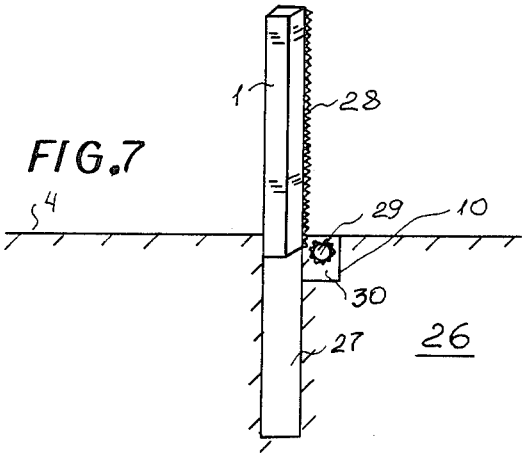

BARRIER POST FOR PARKING LOTS AND PASSAGEWAYS

FIELD OF THE INVENTION

The invention relates to a barrier post for temporarily blocking the access to parking lots, driveways and access roads which is anchored in the ground and is swingable around a hinge running transversally to its longitudinal axis, located at ground level, or can be lowered into the ground.

BACKGROUND OF THE INVENTION

In order to close covered or outdoor parking lots, driveways and access roads, it is known to use barriers or gates equipped with corresponding actuating means, possibly also remote-controlled. Such barriers usually have a rigid, cast-iron base, which on its upper part has the shape of some kind of a spherical head and a correspondingly built barrier which can swing thereabout by 90 or approximately 90 degrees. Such a barrier or blocking device is known from the German Pat. No. 19 60 699.0. A blocking device, which is basically the same, is known from the German Pat. No. 27 12 546.8, but in this case however, the drawing illustrating the stable, cast-iron post has been eliminated. In this case also the barrier per se is swingable around an articulation located on the top of the post, whereby it is insured by a locking device that it can also be actuated manually, in a simple manner. Also known are the round- or square-based simple posts, blocking driveways or accesses, which are foldable and which permit access to the driveway or the entrance way by being folded down. The folding of the post is done manually in this case, and for this purpose the driver has to leave his vehicle. This is bothersome and disadvantageous, particularly in bad weather. Besides, it is also necessary to equip the barrier post with a lock, in order to prevent the folding down of the post by unauthorized persons, for passage.

OBJECT OF THE INVENTION

It is the object of the invention to create a secure, remote-controlled, respectively remote-controllable, barrier post.

SUMMARY OF THE INVENTION

The problem is solved according to the invention by providing the post with a drive responsible for the osillation around the hinge, which can be switched on through a built-in receiver corresponding with a portable emitter.

This way a barrier post is created which can be set into action exclusively through the emitter corresponding with its built-in receiver, which means only by an authorized person. A special safety lock is thus not necessary. The post can be operated from the vehicle and, in any case from a bigger distance, so that the packing and exiting, as well as the turning into driveways and accesses is considerably easier and quicker. Car ports, which are now used more and more in modern building complexes, can be advantageously equipped so that they provide the same safety for vehicles as the heretofore known garages, which means that the posts are again raised and secured at the parking lot. Such car ports are considerably simpler and cheaper to build, so that nowadays this is the solution most likely to be selected when planning building complexes. It is possible without further ado to secure the entrance through several such car ports by posts, in order, for instance, to increase the safety of such parking places.

According to a suitable embodiment of the invention, it is provided that the post be arranged with an inclination towards the direction of access and the drive is set to lock the post in vertical position. In such an embodiment, the post is unlocked by remote control and folds down due to its own weight, so that a vehicle can pass through easily. Thereby it is suitable to provide in the ground a recess to receive the folding post, in order to obtain with the folded post a generally plane ground surface.

The drive and the control can be housed advantageously safe when, as for instance in a further embodiment of the invention, the post is a hollow bar containing the drive and the receiver, and the articulation is a hinge. In this case, the drive and the entire control device can be housed in the post, where they are safe from damages, as well as from the influence of the weather. Due to the hinge construction, the necessary energy supply conduits or other connection parts can be introduced from the ground into the post, without being visible or being influenced from the outside.

A simple and low-maintenance embodiment provides a capstan cooperating with the drive, whose cable ends are fixed in the ground in front of the post, considered in access direction, and are guided over a deflection roller in the area of the articulation. This way, the post can be folded down with sufficient speed, but still securely, and also can be brought back up again. In such an embodiment, the drive can be a simple electromotor, which has simply to be supplied with the necessary energy to be able to have the power required for the actuation of the capstan, without further problems.

In order to be independent from external energy sources, it is advantageous to conceive the drive as an electromotor supplied by solar cells, whereby the solar cells are located on the external surface of the post. The presently known solar cells can provide the energy required for the drive which folds down or pulls up the post, even without direct exposure to the sunlight. Also, the external surface of the post offers enough room for the location of the necessary solar cells. Thereby, sunbeams converging from all possible directions are captured and effectively transformed into energy, so that in the end, even in the dark the required energy is available. In the case of unfavorable conditions, the invention provides for the insertion of an energy storing device between the solar cells and the drive, in order to save and store the energy necessary for the night operation or for foggy days. Suitably, the drive can cooperate with a heating device controlled from the outside, so that the operational capability of the barrier post is always insured, even during bad weather conditions. This is valid also for freezing temperatures.

Particularly in driveways and access roads with heavy traffic, it is advantageous to provide the post with signaling colors, especially with a blinking light. First, a light makes clear which way the post can be folded down, and for this purpose the blinking light is mounted facing the approach direction. Secondly, this way attention is drawn sufficiently early to the existing barrier. Here also the solar cells are of considerable advantage, because they can provide at any time the energy required for the blinking light.

Damage to the post, for instance by a vehicle, is safely prevented by the fact that the drive is equipped with an overload protection. If during reversing, respectively folding down operation, the post hits an obstacle, the continuation of the folding down operation is automatically stopped and thereby the damage is prevented. A similar automatic stoppage feature operates for the erecting of the post.

In order to make sure that the post can not be erected by mistake, for instance when a vehicle passes over it, according to the invention, the receiver should be a selenium cell responding only to the headlight flash of the vehicle and equipped with time-delay relays. This way, the post can be operated only from the vehicle which is already at a certain distance from the post or approaching the post. Damages due to accidental post erection can not take place this way. It is particularly suitable when the receiver is sharp-tuned by means of the selenium cell and and is set to respond to the emitter only then. Due to the cooperation of both initiators, it is insured that the post is neither raised nor folded down by unauthorized third parties. The headlight flash acts in this case very advantageously as an additional safety device. Particularly in the case of a leaving vehicle, any contact with the vehicle can be prevented, due to the time-delay relays; it is also conceivable that instead of the headlight flash another suitable source of light could be used.

According to the invention, a further safety-enhancing possibility is to provide the sender with a chip with personalized code, through which the sender can be switched on and activated in an already established correspondence. This way, protection against unauthorized handling is offered, since through the chip it is first necessary to personally switch on the sender, before it can be operated.

Further or in addition to these features, it is possible to assign to the drive, in the direction of approach, a switch actuatable by the waiting or approaching vehicle. This switch actuatable by the vehicle can be conceived in the form of a ground plate or of a wire loop operating at request. The switch sharp-tunes the drive and/or the receiver. When a vehicle passes over the switch the weight of the vehicle sends an order to the drive with the aid of the described receiver. Alternatively, it is possible to equip the post with a motion sensor, which sharp-tunes the sender and/or the receiver. When the vehicle moves in a specific area in front of the post, the sender is operatable. Absent such movement, the sender and its receiver is not set into action. If the vehicle is stopped on top of the post, the receiver is incapable of taking orders and, likewise, the sender is incapable of contacting the receiver.

It has already been indicated that when the post is conceived as a hollow body, the individual parts of the actuation device can be lodged in the hollow body. Particularly in such an embodiment it is suitable when the articulation is arranged to lie over the driveway. In such an embodiment, any other preparations can be practically eliminated. Therefore, such a blocking device is particularly suitable for already existing access roads and parking places.

In a further embodiment of the invention, the articulation is located underneath the driveway and in the driveway there is a hollow for receiving the post. This way, the post can be lowered into the driveway, so that it will not be an obstacle, which is particularly advantageous for access roads where such a barrier post serves only at night for blocking the entrance. However, the costs connected to this embodiment are higher than the ones for the aforedescribed embodiment example.

In accordance with a further embodiment the drive has a gear wheel and the post, which can be vertically lowered into the ground, has a tooth rack. With the aid of such a device the entire post can be lowered into or raised from the ground, which again has the advantage of a low hindrance for the vehicle, but of course, at a considerably higher cost. Besides it is necessary to have the necessary depth in the ground. Finally, there can be problems due to snow, ice, water and dirt, which can be prevented with adequate protective measures.

In order to facilitate assembly, disassembly and maintenance, in accordance with the invention, the drive, receiver, as well as the mechanical parts are arranged on a mounting rail which can be fastened in the post or the housing. Thereby, it is merely necessary to fasten the rail inside the post, while the remaining assembly work can be done in the shop, so that only the connections have to be established during the final assembly stage at the place where the post is erected.

In order to keep the energy requirements for the lowering and raising of the post as low as possible, it is possible to provide the drive with a cylinder having a hydro bubble reservoir. Due to this hydro bubble reservoir, the peak requirement, for instance at the raising of the post, can be covered without having to switch on every time the drive for the hydraulic cylinder. Besides, this way it is conceivable to reuse the forces present at the lowering of the post, and for this purpose, an additional weight can be mounted on the top of the post, overhanging in the directions of approach and of folding. When such a weight is provided, it becomes superfluous to incline the post in the direction of approach, since it is pulled down by the weight, when the locking device is disengaged.

The driveways and access roads protected by such posts, have to be kept passable for fire engines, emergency medical services or ambulances. In order to avoid the problem of having to provide each such possible user with a separate coded sender, the invention proposes to provide the drive with a switch actuatable by a triangular safety key. These triangular safety keys will be commonly used in the mentioned cases and can also be used in this instance, in order to make the barrier post passable in an emergency. With the aid of this key either the drive is actuated and the post folded down, or with the aid of this key, the drive, and thereby the locking device are disconnected, so that the post can be folded manually. Further it is conceivable that the receiver and sender assigned to the post are equipped with mutually corresponding locking elements. Due to this it is possible, in the first place, to offer the possibility of remote-control of the post only by the owner, respectively leasee of the parking spot, or by the authorized person, when entering or exiting. Besides, with adequate locking means, a general switch can be established, so that the fire engines, the police, the emergency medical service and the ambulance have also the possibility to release the barrier by remote control.

The invention is particularly characterized by the fact, that a barrier post is created, which can be safely and without much effort controlled and operated from an approaching vehicle or from another distant point, without direct influence. The barrier post according to the invention, offers the advantageous possibility to secure so-called car ports and access roads, without the necessity of additional guarding personnel. Each of the authorized persons can operate without difficulty the post from a sufficiently large distance, which is particularly desirable and advantageous under bad weather conditions. Besides, the vacant parking spot is kept vacant for the owner due to the remote-controlled raised barrier post, which is a considerable advantage under the crowded conditions in residential areas. Finally, in the car ports it is possible to raise the barrier post again, after it is passed over by the vehicle, so that this is safe while parked. In the case of several such barrier posts, a corresponding drive is provided, in order to activate them simultaneously. Through a proper arrangement of selenium cells or other switching arrangements it is possible to prevent an unintended raising of the barrier post, so that damages resulting from such protruding parts of the barrier post can certainly be avoided.

BRIEF DESCRIPTION OF THE DRAWING

Further details and advantages of the object of this invention result from the following description of the accompanying drawing, wherein a preferred embodiment with the pertaining details and individual parts is represented. The drawing shows:

FIG. 5 a barrier post with the parts arranged over the driveway,

FIG. 6 a barrier post which can be lowered in a hollow,

FIG. 7 a barrier post which can be lowered into the ground.

DETAILED DESCRIPTION

Figure 1:
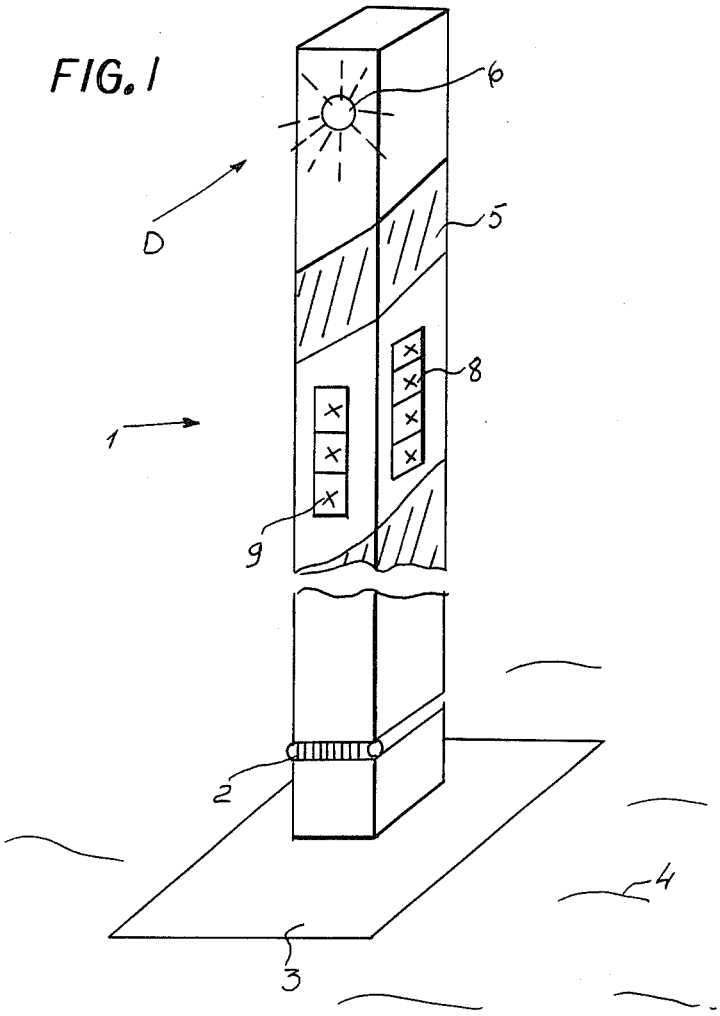
FIG. 1 a perspective representation of the barrier post.

The post 1, represented in perspective in FIG. 1 is foldable around the articulation 2, whereby this articulation is located as close as possible to the ground plate 3 set into the driveway 4. For better identification, the post 1 is provided with a signaling color design 5 and additionally, with the blinking light 6, which is affixed so that it blinks in the approach direction. An electricity supply source for the blinking light 6, as well as for the drive described in the following figures, is provided by solar cells 8, 9 distributed over the surface of the post 1. These solar cells can also cover the entire surface, depending on how much energy is required.

The folding of the post 1 takes place with the aid of the drive 10 which, for instance, is located in the hollow post 1, over the articulation 2. The drive 10 cooperates with a capstan 11 with cable pulley 12 and cable 13. The cable 13 is guided over a deflection roller 14 in the area of the articulation 2 and is fastened with its cable end 15 to the stopper 16 of the ground plate 3. The post 1, erected, for instance with a slight inclination in the direction of approach, tips over due to its own weight and entrains thereby in the idling of the drive 10 the cable 13. Due to this a sufficient braking action occurs, so that the post 1 lands relatively smoothly in its final position.

Figure 2:
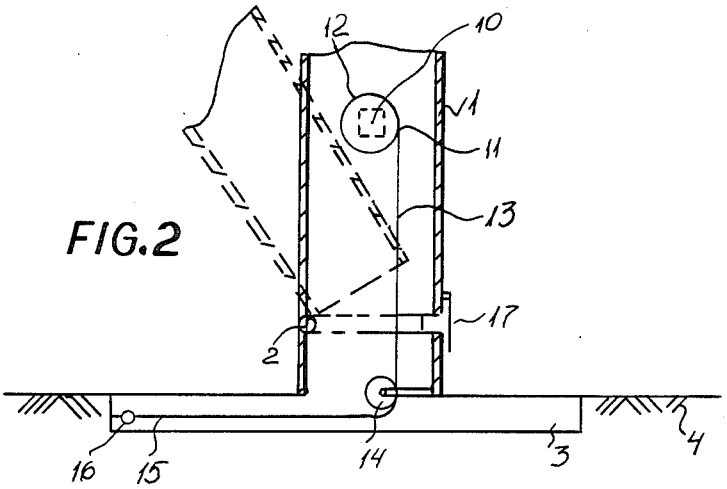
FIG. 2 the lower part of the barrier post in section.

FIG. 2 shows an embodiment wherein the post 1 still projects with respect to the driveway 4. This can be fixed by correspondingly lowering the ground plate 3 into the drive way 4 and by providing a depression for receiving the post 1 in the approach direction.

The articulation 2 is suitably shaped as a hinge and thereby sufficiently sealed. The remaining parts have a protruding seal 17, so that they can not be negatively influenced by bad weather.

Figure 3:
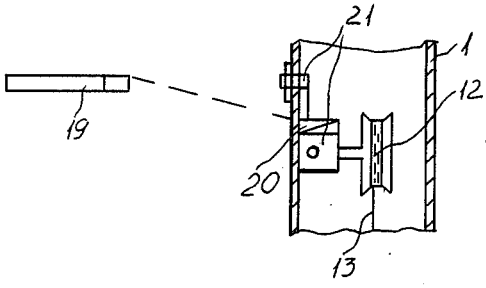
FIG. 3 a sideview of the barrier post in section.

FIG. 3 makes clear how, with the aid of the sender 19 and the receiver 20 cooperating with the drive 10, the control signal necessary for the operation or disconnection of the latter is transmitted. Further, the drive 10 is provided with a connecting/disconnecting switch 21, in order to disconnect the drive 10 when necessary and operate the post 1 manually.

Figure 4:
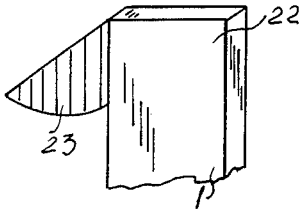
FIG. 4 the top of the barrier post in a sideview.

Finally, FIG. 4 explains that the self-acting folding of the post 1 when the drive 10 is disconnected, can occur also due to a weight 23, mounted on the top 23 and overhanging it, instead of due to the inclination of the post 1.

FIGS. 5, 6 and 7 show different erection possibilities of a post 1. In the embodiment represented in FIG. 1, all the parts of the post 1 are located over the driveway 4. Thereby, the drive 10 and the remaining parts can be lodged inside the hollow post 1, or in the housing 30, especially provided for this purpose, which is protected against damage when passed over by a vehicle, due to special walling. When the post 1 is erected to protect passage ways or entrance ways, the folding direction can be selected at will. If, to the contrary, it serves at the same time for the protection of a parked vehicle, it should be foldable in the approach direction, since after the vehicle passes over it, it can again be raised without further ado and without corresponding space requirements.

FIG. 6 shows a post 1 swingable around the articulation 2, which lowers itself completely into the hollow 25 and this way ceases to be a hindrance, particularly where passage ways are concerned. In its lowered position, which means when it is lodged in the depression 25, it can be passed by vehicles without any difficulty.

In principle, the same stands also for the post 1 represented in FIG. 7, which can be lowered completely into the shaft 27 provided in the ground 26. For this purpose serves, for instance, a drive 10, having a gear wheel 29 meshing into a toothed rack 28. The gear wheel 29 and the drive 10 are lodged in a housing 30, located in the ground 26. The tooth rack 28 is shaped within the post 1 or mounted on it.

Based on the described construction of the post 1, the value of such a blocking device increases, so that it might be suitable to arrange for a protection device against burglary. This can for instance be achieved by covering the fastening devices with the underground, resp. the driveway 4, so that they can be reached by unauthorized persons only through destruction. Other types of covers can be provided, in order to shelter the folded down post 1, whereby the shelter can be additionally secured for instance by suitable locks or similar locking devices.

I claim:

1. Barrier post for the temporary blocking of access to parking places, driveways and access roads, the post being anchored in the ground and swingable around an articulation located in the ground area, the articulation extending transversely to the longitudinal axis of the post, characterized in that the post is provided with a drive activating an oscillation around the articulation, said drive being actuatable by means of a receiver reponsive to a portable emitter;

said post being arranged to be inclined in the approach direction and said drive being set to keep the post locked in an erect position;

said post built as a hollow bar housing the drive and the receiver with the articulation being a hinge;

said drive operating a capstan whose cable end is fastened in the ground in front of the post considered in the approach direction, and is guided over a deflecting roller in an area near the hinge; and said drive being an electromotor supplied by solar cells which are distributed over an external surface of the post.

2. Barrier post according to claim 1, characterized by that the drive is provided with a heating device actuated from outside.

3. Barrier post according to claim 1, characterized by that between the solar cells and the drive an energy storage device is inserted.

4. Barrier post according to claim 1, chracterized by that the post is provided with signaling colors and is equipped with a blinking light facing the approach direction.

5. Barrier post according to claim 1, characterized by that the drive is provided with an overload protection.

6. Barrier post according to claim 1, characterized by that the receiver is a selenium cell responding only to the flashlight signal of a vehicle and is provided with time-delay relays.

7. Barrier post according to claim 1, characterized by that the receiver is sharp-tuned over the selenium cell and can only then be contacted by the emitter.

8. Barrier post according to claim 1, characterized by that the emitter is equipped with a chip with personalized code, through which the sender can be switched on and actuated, in an already established correspondence.

9. Barrier post according to claim 1, characterized by that the drive is controlled by a switch activated by a standing or moving vehicle.

10. Barrier post according to claim 1, characterized by that the articulation is arranged to lie over a driveway.

11. Barrier post according to claim 1, characterized by that the articulation is arranged to lie underneath a driveway and that a depression to receive the post is provided.

12. Barrier post according to claim 1, characterized by that the drive, the receiver, as well as all mechanical parts are mounted on an assembly rail fastenable in the post.

13. Barrier post according to claim 1, characterized by that a top of the post has a weight, which overhangs it in the direction of approach.

* * * * *